US007100247B2

(12) United States Patent
Fujihara et al.

(10) Patent No.: US 7,100,247 B2
(45) Date of Patent: Sep. 5, 2006

(54) CLIP FIXING STRUCTURE

(75) Inventors: Shigeki Fujihara, Tokyo (JP); Kenji Kosuge, Tokyo (JP); Hirozumi Fujiwara, Tokyo (JP)

(73) Assignee: Tokyo Kinzoku Industry Co., Ltd., Tokyo (JP)

( * ) Notice: Subject to any disclaimer, the term of this patent is extended or adjusted under 35 U.S.C. 154(b) by 0 days.

(21) Appl. No.: 10/677,232

(22) Filed: Oct. 3, 2003

(65) Prior Publication Data

US 2004/0099777 A1 May 27, 2004

(30) Foreign Application Priority Data

Nov. 27, 2002 (JP) ..... 2002-344211

(51) Int. Cl.
*B43K 23/00* (2006.01)

(52) U.S. Cl. ..... 24/11 R; 401/104; 401/243

(58) Field of Classification Search ..... 24/11 R, 24/11 HC, 11 S, 11 PP, 10 R, 11 FE, 11 CC, 24/11 CT; 401/6, 98, 202, 244, 104–106, 401/114, 243

See application file for complete search history.

(56) References Cited

U.S. PATENT DOCUMENTS 2,492,028 A * 12/1949 Bauer ..... 24/11 P
3,344,484 A * 10/1967 Zepell et al. ..... 24/11 P
3,920,337 A * 11/1975 Ganz ..... 401/106
4,706,341 A * 11/1987 Celaries ..... 24/11 R
5,074,694 A * 12/1991 Nakazato et al. ..... 401/104
5,535,487 A * 7/1996 Kageyama et al. ..... 24/11 R
5,632,565 A * 5/1997 Yamaguchi ..... 401/202
5,975,783 A * 11/1999 Hu ..... 401/202
6,682,245 B1 * 1/2004 Saitou ..... 401/244

* cited by examiner

*Primary Examiner*—Jack W. Lavinder
(74) *Attorney, Agent, or Firm*—Bacon & Thomas, PLLC

(57) ABSTRACT

A clip fixing structure in which there is no possibility for producing a frictional scratch at an outer surface of a cylinder when it is fixed. The fixing section formed at the rear part of the clip section is bent along widthwise opposing sides and form to face at the rear surface as seen in a front elevational view of the clip section, and the fixing piece sections are provided with the engaging sections. Then, the clip set section formed at the cylinder is adapted to a forward or rearward size and a width size of the inner space of at least the fixing section, its part is protruded in a protruded shape becoming the fixing reference point where the fixing section is fitted, and both side surfaces of the clip set section corresponding to the engaging sections are provided with the holding sections for fixing and holding the fixing section to the clip set section.

4 Claims, 7 Drawing Sheets

CLIP FIXING STRUCTURE

BACKGROUND OF THE INVENTION

1. Field of the Invention

This invention relates to a clip fixing structure fixed to a barrel of a writing instrument or a cosmetic tool and the like or a cylinder such as a cap and the like.

2. Related Art

In the prior art, there has been provided a fixing structure constructed such that an outer surface of a barrel is provided with a fixing member having a fixing hole extending in a forward or rearward direction, a lower piece press fitted into said fixing hole is bent in a rearward direction and formed of a clip section, a slit is arranged from an extremity end of said lower piece to a rearward direction, an extremity end of each of the legs divided by said slit is provided with a wider flange than a width of said fixing hole, and further, a protrusion having a larger diameter than the width of said slit is protruded at a slight forward location of said fixing member, said lower piece is press fitted into said fixing hole, thereby the flanges of said legs are engaged with a front end surface of the fixing member and at the same time said slit is engaged with said protrusion (refer to the patent document 1)

In addition, there has been also provided a fixing structure in which the rear end of the clip piece is provided with a box-like engaging section having a U-shaped sectional surface, a protruded engaging section having said box-like engaging section press fitted is arranged at an outer surface of a cap, a recess extending from an opening part of the extremity end of said box-like engaging section in a longitudinal direction of the clip piece, a notch groove to which said recess is engaged is formed, a raised part cooperatively arranged at the notch groove is arranged at the rear end of the cap piece, the opening part of said box-like engaging section is press fitted from a front end of said protruded engaging part to cause the end surface of the opening part to be abutted against the raised part of the protruded engaging part, and further a recess part extending from the opening part is constructed to be engaged with said protrusion (refer to the patent document 2).

Further, there has been also provided a fixing structure in which a pair of through-pass holes are punched in an outer surface at 180° symmetrical locations of the barrel, a rear end of the clip is provided with a pair of legs forming an outer circumferential surface of the barrel and an inner circumferential surface of substantial same shape, the released ends of said legs are provided with tongue pieces bent inwardly, said tongue pieces are set to have a slight smaller width than an opening length of said through-pass holes, so that said legs are abutted against an outer surface of the barrel and pressed to cause the legs to be pushed and widened along an outer surface of the barrel and the tongue pieces are engaged with said through-pass holes (refer to the patent document 3).

[Patent Document 1]

The gazette of Japanese Utility Model Laid-Open No. Hei 6-55788 (left column, lines 2 to 12, page 2; lines 2 to 15, page 4; and FIGS. 1 to 3)

[Patent Document 2]

The gazette of Japanese Utility Model Laid-Open No. Hei 3-116991 (lines 5 to 19, page 1; line 8, page 5 to line 12, page 6; and FIGS. 1 to 6)

[Patent Document 3]

The gazette of Japanese Utility Model Laid-Open No. Hei 6-4990 (left column, lines 2 to 9, page 2; line 27, page 3 to line 6, page 4; and FIGS. 1 to 3)

However, in the case of the patent document 1, the extremity ends of the legs at a rear part of the clip section are positioned at a rear end opening of the fixing hole of said fixing member when the clip is fixed to the fixing member of the barrel and the legs are press fitted to the fixing holes while the clip is being moved in a forward direction of the barrel. At this time, a ball section formed at the rear surface of the extremity end of the clip section is in contact with the outer surface of the barrel and there occurs a possibility that a scratch is produced at the outer surface of the barrel.

In addition, under a state in which the clip is fixed to the fixing member of the barrel, said fixed member shows an exposed state, resulting in that this fixing structure shows a poor outer appearance and is not suitable for a high-class writing instrument and the like.

Also in the case of the patent document 2, the box-like engaging section at the rear end of the clip piece is press fitted to the protruded engaging section at the outer surface of the cap from its front end while the clip is being moved toward the barrel in the same manner as that of the aforesaid patent document 1. At this time, the ball section formed at the rear surface of the extremity end of the clip piece is kept at a contacted state against the outer surface of the cap and so this contacted state may cause an outer surface of the cap to be frictionally scratched.

Additionally, under a state in which the clip is fixed to the protruded engaging section of the cap, a clearance is produced between the bent part of the box-like engaging section engaged with the concave groove of the protruded engaging section and the outer surface of the cap. That is, a clearance is produced between an outer surface of the cap and a base part (an arcuate part) of the box-like engaging section, this clearance shows a poor outer appearance and this is not suitable for a high-class writing instrument and the like.

In the patent document 3, the clip could be fixed without moving itself toward the cylinder such as a barrel and the like and although a possibility of scratching at the outer surface of the barrel or the like caused by the contact of the ball section found in the aforesaid patent documents 1, 2 was overcome, a fixing of the clip against the barrel was difficult to require a certain time, resulting in that its productivity was poor.

That is, this prior art was set such that both tongue pieces were engaged with both through-pass holes by pushing said legs to the barrel under a state in which both inward directed tongue pieces were abutted against the upper part of the through-pass holes at the outer surface of the barrel, it took a time for positional alignment of the tongue pieces against the through-pass holes, a smooth fixing was difficult, resulting in that it provided a poor productivity and a substantial influence against a yield in productivity.

Additionally, in the case of the patent document 3, a band-like leg having a length wound up to a circumferential half-part (180° symmetrical location) of the barrel is required to be wider than a width of the clip section and an inward directed tongue piece engaged with the through-pass hole of the barrel is required at the edges of the legs, and correspondingly a material loss (useless) is produced. Due to this fact, this clip had a high unit price and a high production cost per one unit due to a loss of material.

This invention has been invented in reference to such circumstances found in the prior art and it is an object of this invention to provide an improved clip fixing structure having no possibility of producing a frictional scratch at the outer surface of the cylinder when it is fixed to the cylinder, producing a convenient fixing to improve its productivity and restrict a loss in material and capable of sufficiently accommodating for its fixing to a high-class writing instrument.

SUMMARY OF THE INVENTION

This invention for accomplishing the problems above is a clip fixing structure in which a fixing section integrally formed at a rear part of a clip section is pushed onto and fitted to a clip set section formed at a cylinder such as a barrel or a cap of a writing instrument or a cosmetic tool and the like through one-finger touch operation; wherein said set section is provided with fixing piece sections at both sides while their both sides are faced toward a rear surface, bent and formed in a width shape approximate to a shape of the clip section as seen in its front elevational view, said fixing piece sections are formed with engaging sections;

said clip set section is adapted in at least a forward or rearward size and a width size of an inner space constituted by at least said both fixing piece sections and protrudes in such a way that its part may become a fixing reference point when said fixing section is pushed onto and fitted to it; and further, locations at both side surfaces of said clip set section corresponding to said engaging sections are formed with holding sections fitted to and engaged to each other and fitting and holding said fixing section to the clip set section.

In this case, said fixing reference point is formed at the rear end section of the clip set section. When the clip is fixed to the cylinder, an opening edge at the rear end in the inner space of the fixing section is aligned along said fixing reference point and pushed onto the clip set section, thereby the engaging sections of both fixing piece sections at the fixing section are fitted and engaged against the holding sections of said fitting section and then it is formed such that the fitting section is fixed and held at the clip set section.

Additionally, it is preferable that the released end edges of both fixing pieces at said fixing section are formed to be adjacent to a direction of the outer surface cylinder of the cylinder (protrusion base sections of both side surfaces of the clip set section), the released end edges of both fixing piece sections are closely contacted with the outer surface of the cylinder under a set state to the clip set section and no clearance is generated between them. With such an arrangement as above, a superior outer appearance can be attained.

Forms of the aforesaid engaging sections and holding sections to be fitted and engaged to each other are not specified.

They may not be specifically restricted to say that for example, the engaging sections can be of hole-like sections or protruded or concave shapes and in turn, the holding sections can be of protruded shape or concave shape substantially adapted for at least the hole opening shape or protruded outer contour shape or concave inner contour shape. It is preferable that the engaging sections are circular or rectangular opened holes, and the holding sections are protrusions protruded to be adapted to at least opening contour shapes of said hole engaging sections.

In addition, it is preferable that the upper half sections of the aforesaid protruded holding sections are formed with tapers for expanding and opening both fixing piece sections outwardly when the hole-like engaging sections are fitted to and engaged with said holding sections.

Additionally, it is preferable that the protruding base ends of said protruded holding sections are formed with the stoppers to which the opening edges of said hole-like engaging sections are partially engaged under a state that the hole-like engaging sections are fitted to and engaged in a groove width corresponding to a plate thickness of each of the fixing piece sections. With such an arrangement as above, a fitted state of the fixing section against the clip set section becomes more solid one and then it is possible to prevent it positively that the fixing section is removed from the clip set section when the clip spring-up operation is frequently carried out during its storing at a pocket of clothes and the like.

Further, the aforesaid fixing section and clip set section are provided with anti-lateral vibration means to cause both the fixing section and clip set section to be fitted and engaged to each other when the fixing section is pushed onto and fitted to the clip set section, and even in the case that a force in a lateral direction acts against the clip section, a lateral vibration is not produced at the fitted state of the fixing section against the clip set section and the fixing section is fixed and held to the clip set section under a rigid state.

BRIEF DSCRIPTION OF THE DRAWINGS

Figure 3A:
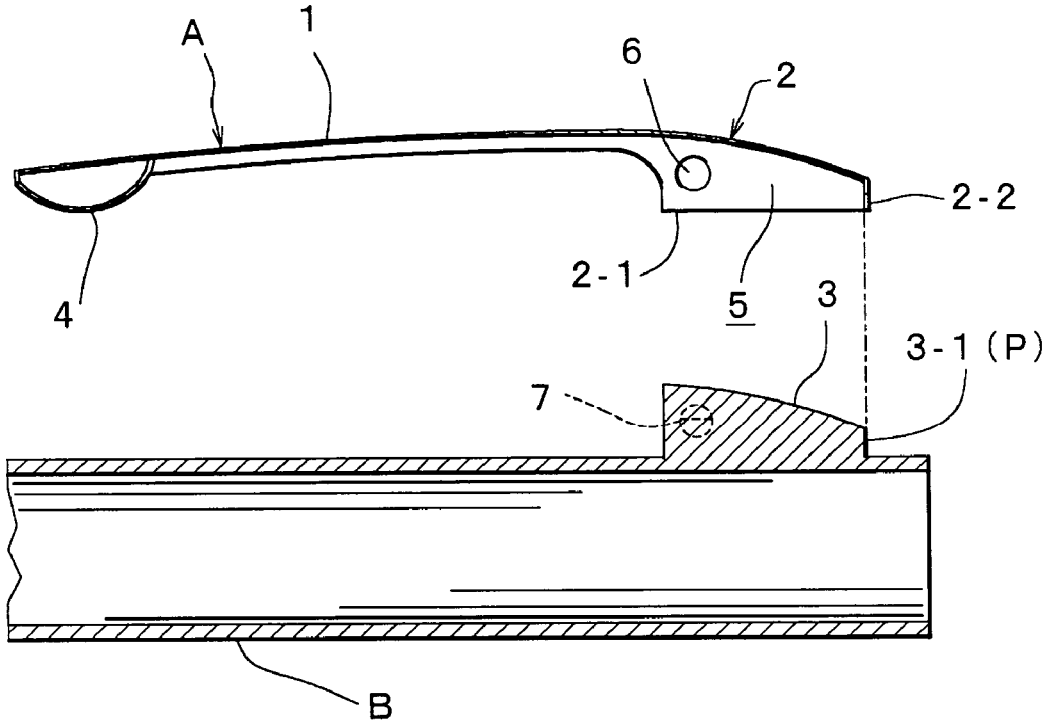
Figure 3B:
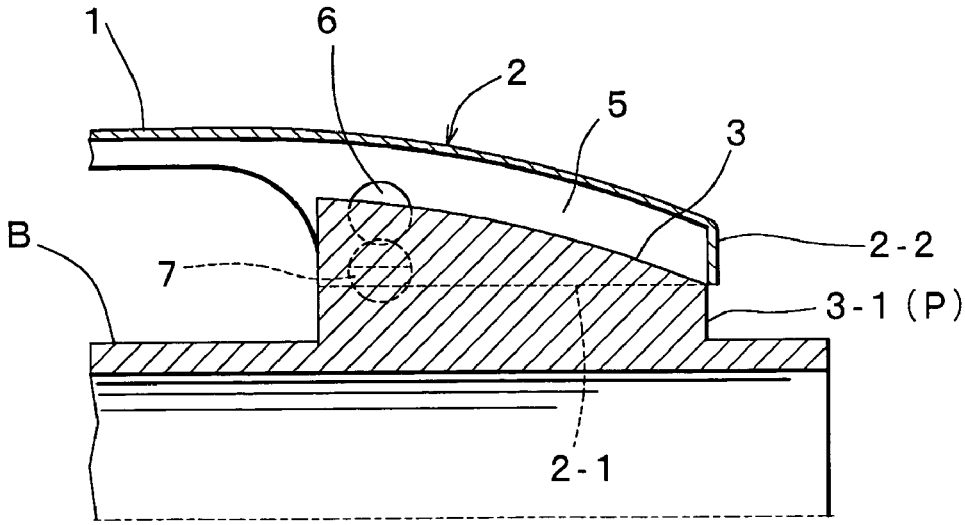

FIGS. 3A and 3B show one example of a method for fixing a clip against a cylinder and FIG. 3A is a side elevational view in longitudinal section for showing a state in which a rear end bent section of the fixing section is positioned along the rear end raised section of the clip set section acting as a fixing reference point; and FIG. 3B is an enlarged substantial view for showing a state in which the fixing section is pushed onto the clip set section up to a position where the opening edge of the rear end bent section extends along the rear end raised section.

Figure 4A:
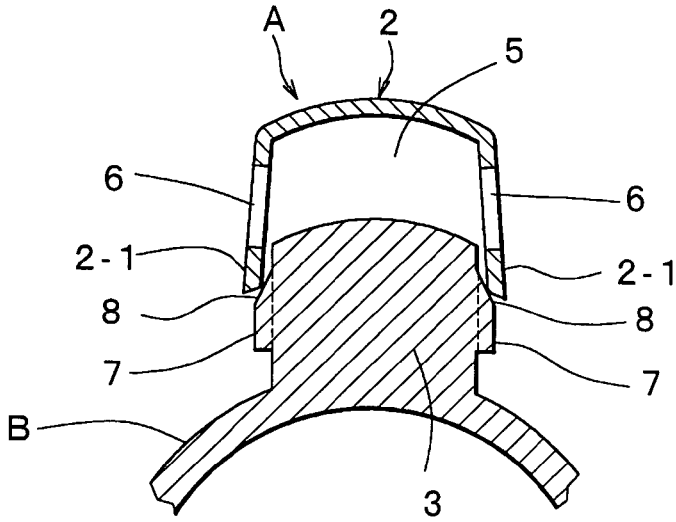
Figure 4B:
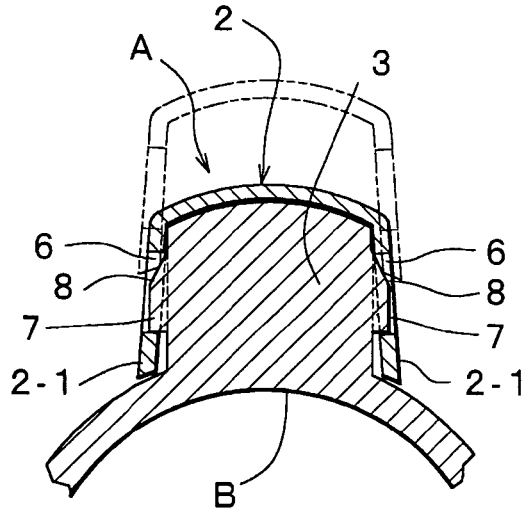
Figure 4C:
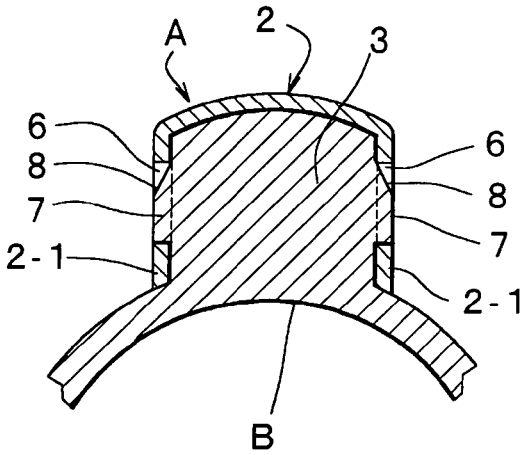

FIGS. 4A, 4B, and 4C are a substantial cross sectional enlarged view for showing a process in which the clip fixing section is pushed onto and fitted to the clip set section of the cylinder, FIG. 4A shows a state in which both fixing piece sections are widened outwardly by the tapers of the holding sections; FIG. 4B shows a state in which the hole-like engaging sections are coincided with the protruded holding sections and the hole-like engaging sections are fitted to and engaged with the protruded holding sections with a recovering force where both fixing piece sections return to their original state; and FIG. 4C shows a state in which the hole-like engaging sections are fitted to and engaged with the protruded holding sections, and the fixing section is fastened and held at the clip set section.

Figure 5:
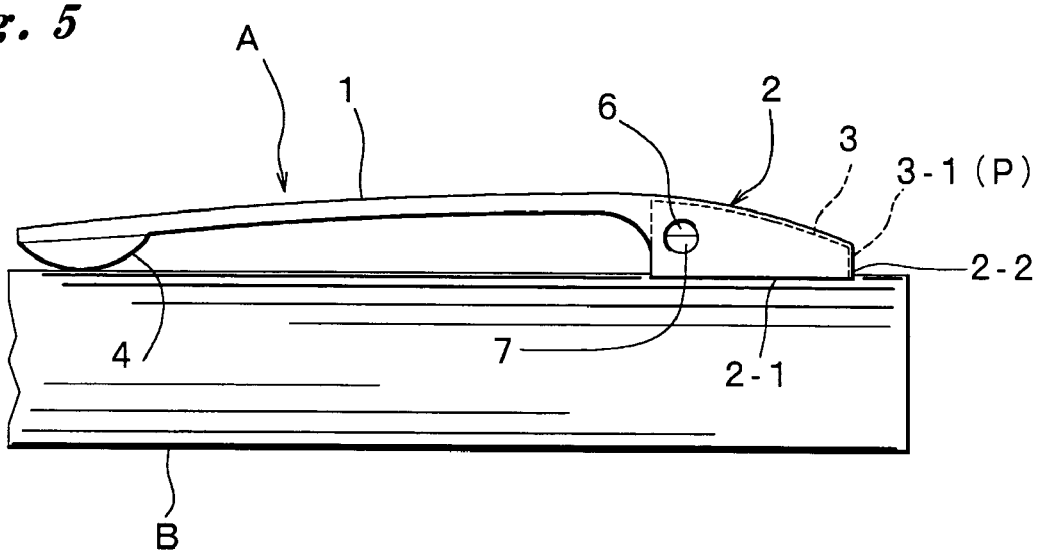

FIG. 5 is a side elevational view for showing a state in which the clip is fixed to the cylinder.

Figure 6:
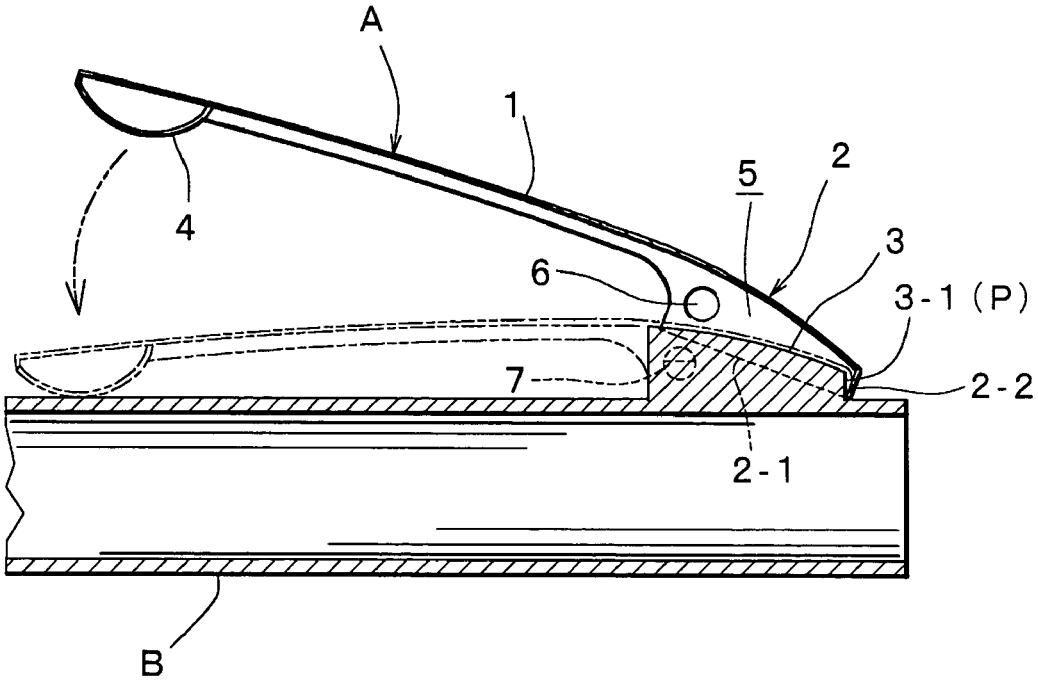

FIG. 6 is a side elevational view in longitudinal section for showing another example of a method for pushing the fixing section onto and fitting it to the cap set section.

Figure 7:
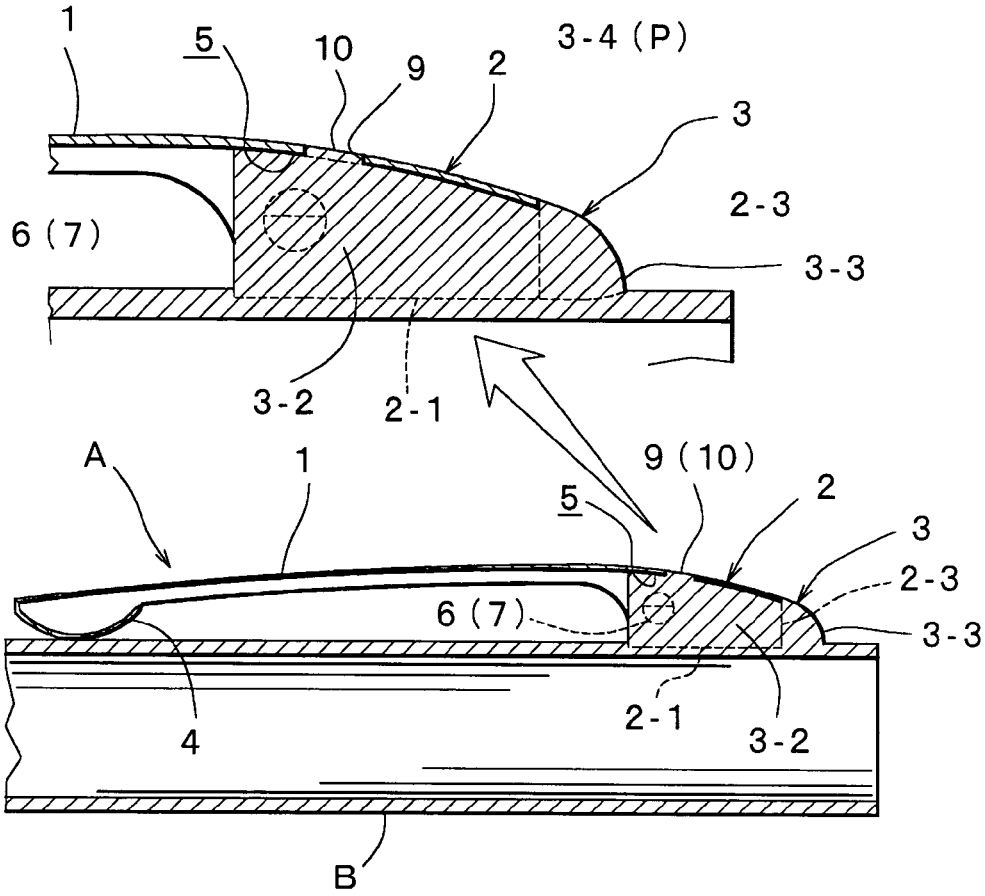

FIG. 7 is a side elevational view in longitudinal section for showing another preferred embodiment of the fixing structure of the present invention.

Figure 8:
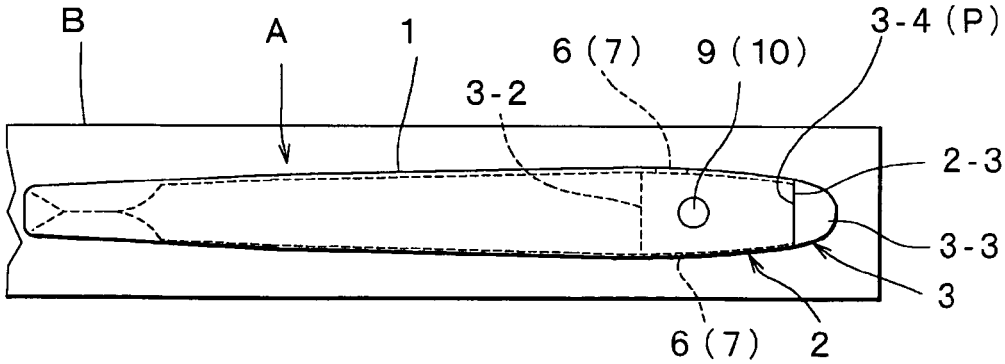

FIG. 8 is a front elevational view of FIG. 7.

Figure 9:
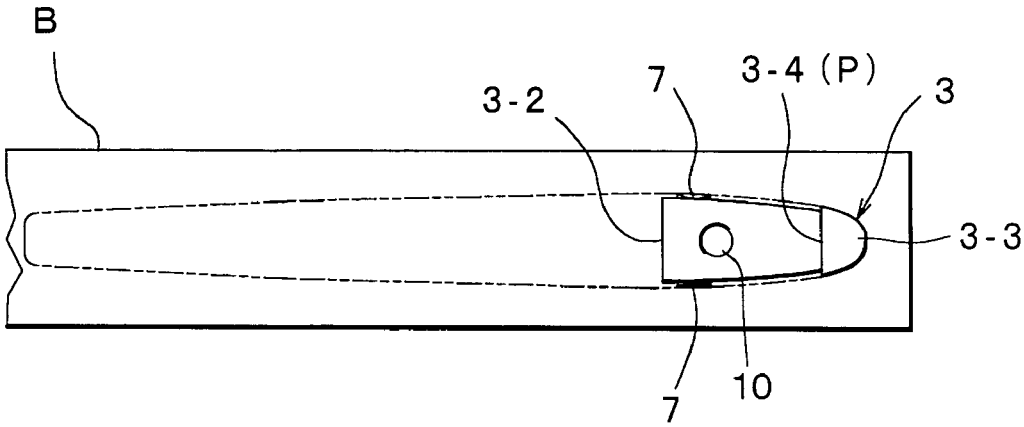

FIG. 9 is a front elevational view for showing only the cylinder.

Figure 10:
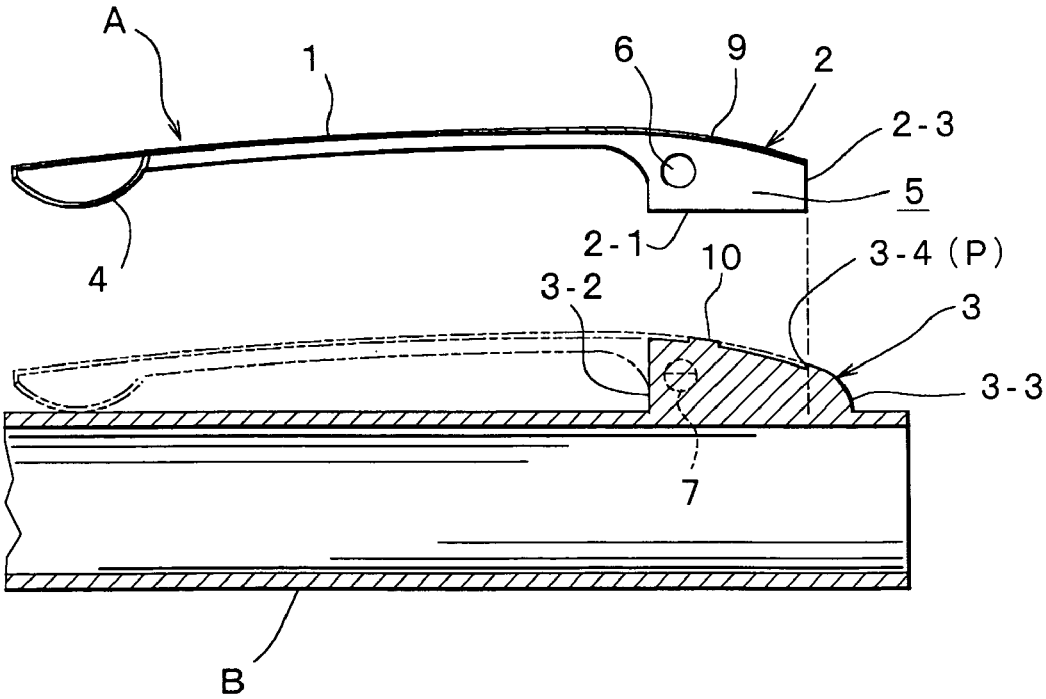

FIG. 10 is a side elevational view in longitudinal section for showing one example of a method for fixing the clip against the cylinder, wherein it shows a state in which the rear end opening edge of the fixing section is positioned along the step of the clip set section acting as a fixing reference point.

Figure 11:
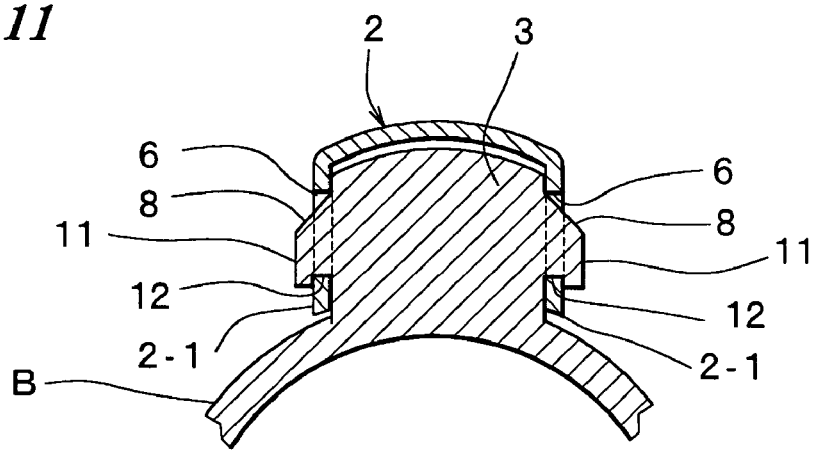

FIG. 11 is a substantial cross sectional enlarged view for showing another preferred embodiment in which forming states of the engaging sections and the holding sections in the fixing structure of the present invention are changed.

Figure 12:
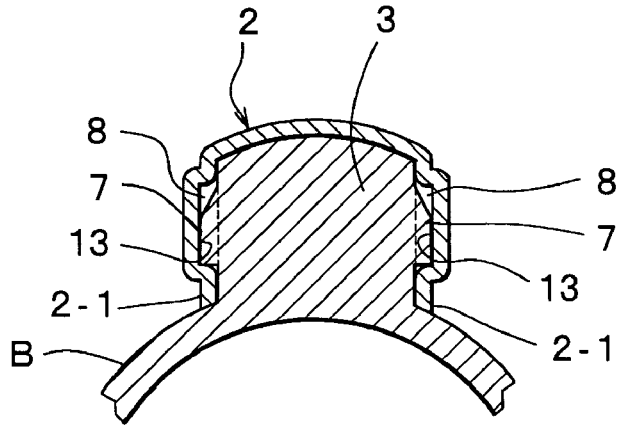

FIG. 12 is similarly a cross sectional enlarged view for showing another preferred embodiment.

Figure 13:
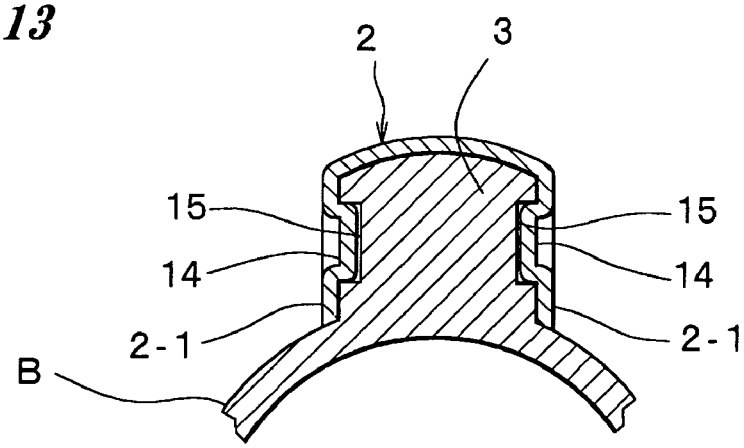

FIG. 13 is similarly a cross sectional enlarged view for showing still another preferred embodiment.

DESCRIPTION OF THE PREFERRED EMBODIMENTS

Referring now to the drawings, some preferred embodiments of the present invention will be described as follows.

The drawings illustrate one example of the preferred embodiments of the clip fixing structure of the present invention. A denotes a clip and B denotes a cylinder.

The clip A is set to be fixed and held at an outer surface of the cylinder B by fitting the fixing section 2 formed at a rear part of the clip section 1 against the clip set section 3 formed at the outer surface of the cylinder B through one-finger touch operation merely pushing it from above (a front elevational direction).

The cylinder B is a main body section of a barrel or a cap for a writing instrument or a cosmetic tool or the like and other portable small-sized item molded by synthetic resin material, and in the case that the cylinder B is a barrel such as a writing instrument as shown in the figure, for example, the clip set section 3 is installed at a predetermined location of an outer surface of the cylinder B through a simultaneous molding.

The clip A is manufactured by a series of punching and bending work with a desired metallic plate and is integrally provided with the clip section 1 and the fixing section 2 formed to have a bow shape as seen in a side elevational view.

The rear surface of front end of the clip section 1 (an opposing surface against the cylinder B) is formed with a ball section 4 through a bending work.

The fixing section 2 is integrally formed at a rear part of the clip section 1 through a punching and bending work together with the clip section 1 in a bow shape gradually bent more largely than the bow shape of the clip section 1 as seen in a side elevational view, and this fixing section 2 is provided with fixing piece sections 2-1 bent and formed in a faced manner at both sides toward the rear surface side with a width shape near a shape as seen in a front elevational view at the clip section 1.

Then, the rear end bent section 2-2 cooperatively arranged in a substantial arcuate shape as seen in a front elevational view in concurrent with the bending of both fixing piece sections 2-1. Then, the inner space 5 opened at least in a forward direction (a direction toward the ball section 4) and a downward direction (a direction toward the surface of the cylinder B) is assured and formed.

In addition, the fixing piece sections 2-1 are formed to face toward the rear surface together with the rear end bent section 2-2 by a drawing and bending work with a width shape near to a shape as seen in a front elevational view of the clip section 1 and concurrently the rear end bent section 2-2 is integrally and cooperatively formed. These released lower end edges are formed along and near the cylindrical direction of the outer surface of the cylinder B (protrusion base portions at both side surfaces of the clip set section 3) under a state in which they are set at the clip set section 3 of the cylinder B.

Then, opposing locations at the forward releasing edges of both fixing piece sections 2-1 are provided with engaging sections 6. The engaging sections 6 are fitted to and engaged with the holding sections 7 of the clip set section 3 to be described later, and the fixing section 2 can be rigidly and forcedly fixed and held at the clip set section 3 under a state in which it may not be removed.

The engaging sections 6 are holes opened in a circular shape by a predetermined size and the engaging sections 6 are fitted to and engaged with the holding sections 7 formed to be protruded during a process in which the fixing section 2 is pushed onto and fitted to the clip set section 3.

The clip set section 3 has a protruded shape substantially adapted for both sizes in a forward or rearward direction and a width direction of the opening of the inner space 5 assured and constituted at its rear surface by both fixing piece sections 2-1 and rear end bent section 2-2 of the aforesaid fixing section 2 and then the clip set section 3 is formed (molded) in a protrusion shape at the outer surface of the cylinder B. When the fixing section 2 is fitted to and set, it is formed in a protrusion shape having at its rear end the rear end raised section 3-1 acting as the fixing reference point P of the fixing section 2. Side surface locations at both fixing piece sections 2-1 corresponding to said engaging sections 6 are formed with holding sections 7.

Figure 1:
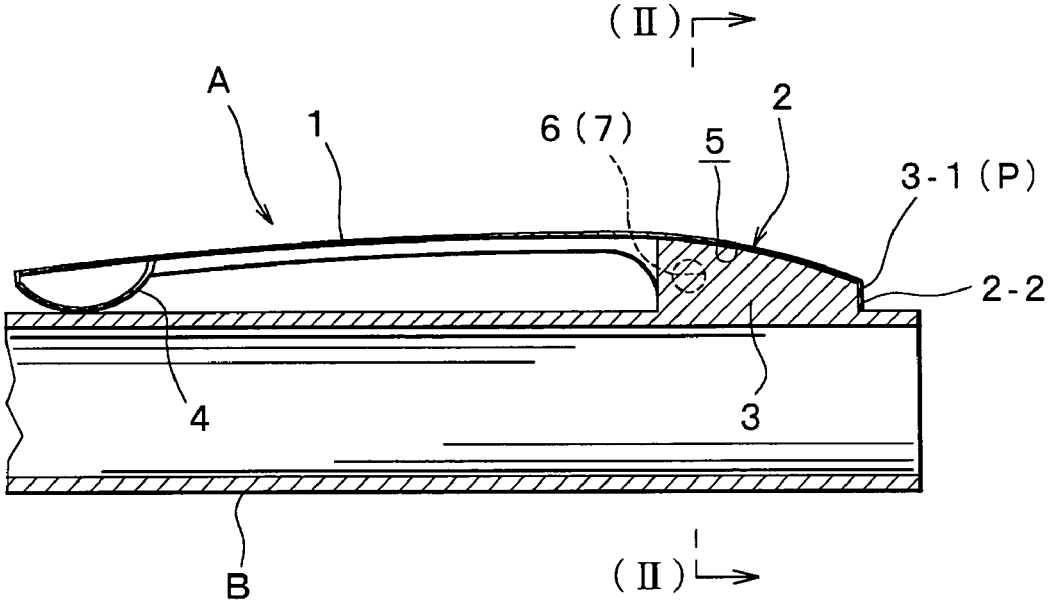
FIG. 1 is a side elevational view in longitudinal section for showing one example of a preferred embodiment of a fixing structure of the present invention.
Figure 2:
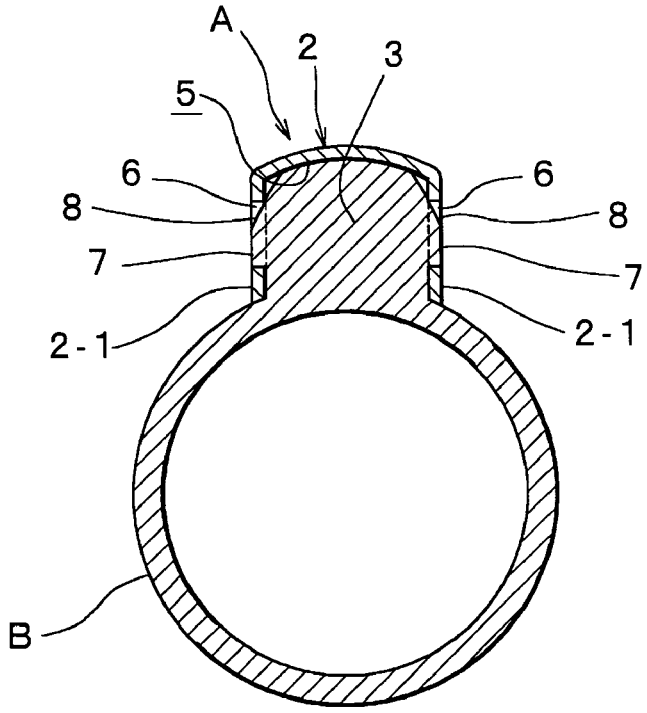
FIG. 2 is an enlarged cross sectional view taken along line II—II of FIG. 1.

As shown in FIG. 2, it is desirable that corners at both upper ends of the clip set section 3 are chamfered.

The holding sections 7 are used for fixing and holding the fixing section 2 to the clip set section 3 through fitting and engaging with the engaging sections 6, and the holding sections 7 are protruded at both side surfaces of the clip set section 3 with substantial same shape as that of an opening of the engaging sections 6.

Further, a protruding height of the holding sections 7 is set in a range of plate thickness of the fixing piece sections 2-1, thereby the holding sections 7 are stored substantially in flush with the engaging sections 6 without being protruded out of the engaging sections 6 under a state in which the engaging sections 6 are being engaged with them.

In addition, the upper half part of the aforesaid holding sections 7 is formed with tapers 8 for expanding outwardly both fixing piece sections 2-1 when the fixing section 2 is pushed onto and fitted to the clip set section 3 and for guiding them in such a way that the engaging sections 6 are smoothly fitted to and engaged with the holding sections 7.

The fixing structure of the present embodiment constructed as described above will be described in brief.

At first, the fixing section 2 is positioned at the clip set section 3 along the rear end bent section 2-2 of the fixing section 2 (abutted) at the rear end raised section 3-1 of the clip set section 3 becoming the fixing reference point P for the fixing section 2 in respect to the clip set section 3, and the fixing section 2 is pushed to cover the clip set section 3 (from the state (a) to the state (b) in FIG. 3).

Then, both fixing piece sections 2-1 are pushed wide outwardly by the tapers 8 formed at the protruded holding sections 7 for the clip set section 3 during this pushing and fitting process, and the rear end bent section 2-2 is placed near and along in respect to the rear end raised section 3-1, thereby the positional alignment of the hole-like engaging sections 6 in respect to the protruded holding sections 7 is carried out.

Then, when the hole-like engaging sections 6 are coincided with the protruded holding sections 7 through a continuous pushing operation, the hole-like engaging sections 6 are fitted to and engaged with the protruded holding sections 7 with a recovering force (a resilient force) by which both fixing piece sections 2-1 pushed wide outwardly are returned to their original state (from the state (a) to the state (c) in FIG. 4). With this arrangement, the clip A is fixed to and held at the cylinder B (the state in FIG. 5).

The aforesaid fixing method is a mere example of fixing method and is not restricted in its interpretation. It is also possible for the hole-like engaging sections 6 to be fitted to and engaged with the protruded holding sections 7 and the clip A to be fixed and held at the cylinder B by a method, as shown in FIG. 6, for example, that the opening edge of the rear end bent section 2-2 of the fixing section 2 is abutted against the base end of the rear end raised section 3-1 of the clip set section 3 acting as the fixing reference point P, and the fixing section 2 is pushed onto the clip set section 3 so as to cause the front end of the clip section 1 to fall toward the cylinder B under this state.

Additionally, although not shown, it is also possible to apply a fixing method in which the fixing section 2 is pushed onto and fitted to the clip set section 3 from a slant upper part (rear side) of the clip set section 3. In brief, it is possible to perform that the positional alignment of the hole-like engaging sections 6 of the fixing section 2 in respect to the protruded holding sections 7 of the clip set section 3 is carried out positively and the hole-like engaging sections 6 are rapidly fitted to and engaged with the protruded holding section 7 by pushing the clip section onto the clip holding section with the rear end bent section 2-2 of the fixing section 2 being placed along the rear end raised section 3-1 of the clip set section 3.

FIGS. 7 to 10 illustrate another preferred embodiment of the clip fixing structure of the present invention.

The fixing structure in such a preferred embodiment as above is constructed such that the fixing section 2 is formed to assure and form the inner space 5 opened forwardly (a direction toward the ball section 4) and downwardly (a direction toward the surface of the cylinder B) as well as rearwardly (a rearward direction of the cylinder B) by bending both fixing piece sections 2-1 described in detail in the aforesaid preferred embodiment to face against the rear surface with a width shape extending along a shape as seen in a front elevational view of the clip section 1, and both fixing piece sections 2-1 are provided with the engaging sections 6 described in detail in the aforesaid preferred embodiment.

Then, the clip set section 3 onto which the fixing section 2 is pushed and fitted is comprised of a fitting section 3-2 having a protruded shape substantially adapted for both sizes in a forward direction and a width direction of the opening of said inner space 5 and formed in a protruded shape at an outer surface of the cylinder B; and a head section 3-3 contacted with the rear end opening edge 2-3 of the fixing section 2, engaged to close said opening and protruded from the fitting section 3-2 toward the cylinder to extend along a surface shape of the fixing section 2.

Although the clip set section 3 is formed at the surface of the cylinder B through a simultaneous molding, a step 3-4 acting as the fixing reference point P for the fixing section 2 is protruded and formed to bulge out outwardly with a step difference corresponding to a plate thickness of the fixing section 2 by contacting the rear end opening edge 2-3 of said fixing section 2 to an interface between the fitting section 3-2 and the head section 3-3 when the fixing section 2 is fitted and set, and at the same time, locations corresponding to said engaging sections 6 at both side surfaces of the fitting section 3-2 are formed with the holding sections 7 described in detail in the aforesaid preferred embodiment.

As described above, the constitution other than those where the fixing section 2 of the clip A and the clip set section 3 arranged at the cylinder B are changed is basically the same as that described in detail in the aforesaid preferred embodiment, so that the same reference symbols are applied to the same composing sections to eliminate their overlapped description.

Further, in the case of the aforesaid preferred embodiment, there are provided anti-lateral vibration means to be fitted and engaged with each other at the time when the fixing section 2 of the clip A is pushed onto and fitted to the fitting section 3-2 of the clip set section 3 arranged at the cylinder B, as illustrated in the drawings.

The anti-lateral vibration means is provided with a hole 9 arranged at the fixing section 2, and a protrusion 10 arranged at the clip set section 3. The hole 9 is fitted to and engaged with the protrusion 10 to prevent the lateral-vibration of the fixing section 2 from being applied. That is, an accidental opening of both fixing piece sections 2-1 is prevented by the anti-lateral vibration means.

With such an arrangement as above, even in the case that a lateral force is applied to the clip section 1, the fixing section 2 is fixed to and held at the clip set section 3 under a rigid state where no lateral vibration occurs in the fitted state of the fixing section 2 against the clip set section 3, resulting in that its quality is improved.

Next, the fixing structure of the preferred embodiment of the present invention constructed as described above will be described in brief.

At first, the fixing section 2 is positioned at the clip set section 3 (a state shown in FIG. 9) in such a way that the rear end opening edge 2-3 of the fixing section 2 is approached along (abutted) the step 3-4 of the clip set section 3 acting as the fixing reference point P of the fixing section 2 in respect to the clip set section 3 (a state in FIG. 9), and the fixing section 2 is pushed onto the clip set section 3 under this state.

Then, as described in detail in the aforesaid preferred embodiment, both fixing piece sections 2-1 are pushed wide outwardly by the tapers 8 formed at the protruded holding sections 7 of the clip set section 3 during the setting process, the rear end opening edge 2-3 of the fixing section 2 extends along the step 3-4 of the clip set section 3 to cause the positional alignment of the hole-like engaging sections 6 in respect to the protruded holding sections 7 to be carried out and the hole-like engaging sections 6 are coincided with the protruded holding sections 7 under a continuous pushing operation. With such an arrangement as above, the hole-like engaging sections 6 are fitted to and engaged with the protruded holding sections 7 and at the same time the holes 9 of the fixing section 2 are fitted to and engaged with the protrusion 10 of the clip set section 3 (refer to an enlarged view of FIG. 7).

FIGS. 11 to 13 illustrate another preferred embodiment in which a forming embodiment of the engaging sections arranged at the fixing section 2 of the clip A in the fixing structure of the present invention and the holding sections arranged at the clip set section 3 of the cylinder B is changed.

FIG. 11 shows an arrangement in which the protruded holding sections 11 arranged at both side surfaces of the clip set section 3 protrude outwardly a little from the hole-like engaging sections 6 opened at both fixing piece sections 2-1 of the fixing section 2, the lower portions of the protruded sections form a protruded shape more slightly protruded than an opening shape of the hole-like engaging sections 6, and the stoppers 12 for the fixing piece sections 2-1 are arranged at the lower part.

The stoppers 12 are formed at a lower side of the aforesaid protruded holding sections 11 in a groove width corresponding to a plate thickness of the fixing piece sections 2-1. The hole-like engaging sections 6 are fitted to and engaged with the protruded holding sections 11 to cause a part (the lower side) of the opening edges of the hole-like engaging sections 6 to be engaged as shown in the drawing. A recovering force to cause the fixing piece sections 2-1 widened outwardly by the tapers 8 to be returned to their original states carries out this engagement.

With this arrangement, the fitted state of the fixing section 2 in respect to the clip set section 3 becomes more rigid, and the fixing section 2 is positively prevented from being removed from the clip set section 3 when the clip section 1 is frequently sprung up in such a case as an occasion of storing it in a pocket of clothes and the like.

In FIG. 12, both fixing piece sections 2-1 of the fixing section 2 are formed with concave engaging sections 13, and the concave engaging sections 13 are fitted to and engaged with the protruded holding sections 7 described in detail in the aforesaid preferred embodiment.

In FIG. 13, both fixing piece sections 2-1 of the fixing section 2 are formed with inward faced protruded engaging sections 14, both side surfaces of the clip set section 3 are formed with the concave holding sections 15 so as to be adapted to the protruded engaging sections 14 so as to cause the protruded engaging sections 14 to be fitted to and engaged with the concave holding sections 15.

Further, in the preferred embodiments shown in FIGS. 11 to 13, the reference symbols are applied to the composing portions which are basically the same as those described in detail in the aforesaid preferred embodiment so as to eliminate any overlapped description.

In addition, it is of course optional that the number of mounting locations for the engaging sections and the holding sections is not limited to one location, but they are arranged at two to several locations, thereby a fitting of the fixing section 2 in respect to the clip set section 3 is set to be more rigid. In other words, it is possible that the fixing structure of the present invention is properly changed or modified within a scope of the technical concept described in any of claims 1 to 5.

[Effects of the Invention]

The clip fixing structure of the present invention shows the following actions and effects because it is constructed as described above.

The ball section at the clip section is not contacted with the surface of the cylinder and does not produce any frictional scratch at the surface because the fixing section cooperatively arranged at the rear part of the clip section is pushed and fitted to cover from above the clip set section protruded at the cylinder.

In addition, in the case that the fixing section is pushed onto and fitted to the clip set section, a part (the rear end raised section) of said set section acts as the fixing reference point P, thereby the engaging sections can be fitted to and engaged with the holding sections under a state in which the engaging sections of the fitting section are aligned in position to the holding sections of the clip set section, thereby the fixing section can be fixed through one-finger touch operation where it is merely pushed onto the clip set section.

Accordingly, it can be expected that productivity can be improved because a substantial reduction in fixing time can be attained.

Further, it becomes possible to attain a new curved design of gradual streamline shape (a bow shape) of the entire clip including the fixing section of a shape as seen in its front elevational view (both edge shapes in a width direction) as described in detail in the preferred embodiment because the clip fixing section can be pushed onto and set to the clip set section of the cylinder to cover it from above location.

In other words, in the case of a sliding system in which the box-type engaging section at the rear end of the clip piece is press fitted and fixed to the protruded engaging section at the outer surface of the cap by axially moving (sliding) the clip toward the cylinder as described in the prior patent document 2, an entire clip design is restricted such as a restriction as one in which a width size of the inserting port to the protruded engaging section must be formed wider than that of another part of the entire clip at a usual box of which shape as seen in a front elevational view is in parallel or a box-type engaging section.

In addition, the fixing section can be fixed to cover the clip set section and further the released end edges of both fixing piece sections at the fixing section can be fixed under a state in which they are closely fitted to the outer surface of the cylinder without any clearance, thereby it can adapt for the fixing of the clip to a high-class writing instrument under a state not damaging any outer aesthetic appearance. In other words, it is possible to fix the clip to the cylinder under a complete blind state where the clip set section is not exposed outside.

In addition, the stoppers for stopping a removal of the engaging sections are installed at the holding sections under a state in which the hole-like engaging sections are fitted to and engaged with the protruded holding sections, thereby even if the clip section is frequently sprung up, there is no possibility that the clip fixing section is removed from the clip set section, resulting in that assurance of quality becomes more positive.

Further, the fixing section is provided with both fixing piece sections bent at the rear surface along the width shape of the clip section and a part of or several locations of said both fixing piece sections are provided with hole-like or protruded or concave engaging sections, so that it is not necessary to arrange the engaging claws such as tongue pieces directed inwardly from the fixing piece section as described in the prior patent document 3 and correspondingly it is possible to restrict a loss (useless state) of material.

Additionally, the fixing section and the clip set section are provided with the anti-lateral vibration means composed of holes and protrusions fitted to and engaged to each other when the fixing section is pushed onto and fitted to the clip set section, thereby even in the case that a force in a lateral direction acts at the clip section, the fixing section is fixed and held at the clip set section under a rigid state where no lateral vibration is produced at the fitted state of the fixing section against the clip set section. With such an arrangement as above, quality can be improved.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A clip fixing structure in which a fixing section formed at a rear part of a clip section is pushed onto and fitted over a clip set section formed on and outside of a cylinder to attach a clip to the cylinder, wherein:

said fixing section is provided with fixing piece sections, which are bent in opposition to one another to form a width shape approximate to a shape of the clip set section as seen in its front elevational view, said fixing piece sections being formed with engaging sections;

said fixing section is further provided with a top section that is attached at each edge to the fixing piece sections and has a width approximate to a shape of the clip set section as seen in its front elevation view, said top section being formed with a hole;

said clip set section protrudes outwardly from the cylinder in such a way that a rear end raised section of the clip set section becomes a fixing reference point when said fixing section is pushed onto and fitted to said clip set section;

said clip set section is further provided on the top of said clip set section with a protrusion that corresponds to said hole of said top section of said fixing section and is fitted to and engaged with said hole formed in the top section of said fixing section to provide anti-lateral vibration means when the fixing section is pushed onto and fitted to the clip set section;

locations at both side surfaces of said clip set section that correspond to said engaging sections are formed with holding sections fitted to and engaged to each other and fitting and holding said fixing section to the clip set section, and said fixing piece sections are resiliently bent to cover said clip set section such that the engaging sections of said fixing piece sections engage the holding sections of said clip set section;

the engaging sections are holes and in turn, the holding sections are protrusions adapted to at least a contour shape of opening of said engaging sections; and wherein substantial portions of upper half section of the holding sections are formed with tapers to cause both said fixing piece sections to be expanded outwardly when the engaging sections are fitted to and engaged with said holding sections.

2. The clip fixing structure according to claim 1, wherein the lower surfaces of the holding sections at the protrusion base sections are formed with stoppers that extend downwards toward the cylinder and below the opening of the engaging section for the fixing piece sections.

3. The clip fixing structure according to claim 1, wherein the engaging sections are notches concaved outwardly and in turn, the holding sections are protrusions adapted at least to a concave inner contour shape of said engaging sections.

4. The clip fixing structure according to claim 1, wherein the engaging sections are protrusions protruded inwardly and in turn, the holding sections are concave portions adapted at least to a protruded outer contour shape of said engaging sections.

* * * * *